US005327931A

United States Patent [19]

Royalty et al.

[11] Patent Number: 5,327,931

[45] Date of Patent: Jul. 12, 1994

[54] FLUSH VALVE LEAKAGE PREVENTION AND DETECTION DEVICE

[75] Inventors: Galen E. Royalty, Silver Spring; Gerald S. Gelfeld, Rockville, both of Md.

[73] Assignee: Waterguard, Inc., Rockville, Md.

[21] Appl. No.: 101,258

[22] Filed: Aug. 2, 1993

Related U.S. Application Data

[63] Continuation-in-part of Ser. No. 830,302, Jan. 31, 1992, Pat. No. 5,232,011.

[51] Int. Cl.[5] ..... F16K 31/20; F16K 33/00

[52] U.S. Cl. ..... 137/410; 4/324; 4/366; 4/415; 4/427; 137/421; 137/426

[58] Field of Search ..... 4/324, 325, 366, 381, 4/384, 385, 386, 405, 415, 427; 137/410, 420, 421, 426; 251/74

[56] References Cited

U.S. PATENT DOCUMENTS

| | | | |
|---|---|---|---|
| 265,709 | 10/1882 | Sniffen | 4/366 |
| 1,984,394 | 12/1932 | Candee | 4/366 |
| 2,837,111 | 6/1958 | Mueller | 137/410 |
| 2,841,169 | 7/1958 | Martin et al. | 137/400 |
| 3,095,577 | 7/1963 | Clark | 4/333 |
| 3,348,242 | 10/1967 | Wilhelm | 4/366 |
| 3,363,643 | 1/1968 | Skulski | 137/421 |
| 3,401,717 | 9/1968 | Lamb | 137/421 |
| 3,419,912 | 1/1969 | Kertell | 4/324 |
| 4,216,555 | 8/1980 | Detjen | 4/415 |
| 4,296,505 | 10/1981 | Chien-Sheng | 4/324 |
| 4,351,071 | 9/1982 | Clar | 4/324 |
| 4,391,003 | 7/1983 | Talerico et al. | 4/415 |
| 4,485,501 | 12/1984 | Kloner | 4/405 |
| 4,700,413 | 10/1987 | Lopez | 4/324 |
| 4,791,689 | 12/1988 | Garcia De Couto | 4/366 |
| 4,843,657 | 7/1989 | Orr | 4/405 |
| 4,901,377 | 2/1990 | Weir | 4/415 |
| 5,083,323 | 1/1992 | Cannan | 4/415 |

FOREIGN PATENT DOCUMENTS 488402 7/1938 United Kingdom .

*Primary Examiner*—George L. Walton

[57] ABSTRACT

A flush valve leakage prevention and detection device includes a hood for being assembled over a water inlet valve assembly of a toilet tank, a latch for being mounted by the hood for rotation from a locked position wherein a locking arm of the latch holds a float lever of the water inlet valve assembly in a raised position corresponding to a closed position for the water inlet valve assembly and an unlocked position wherein the locking arm is disengaged from the float lever to allow the float lever to move to a lowered position corresponding to an open position for the water inlet valve assembly in response to flushing of the toilet tank and a stop for preventing over rotation of the latch to the unlocked position to permit the latch to automatically return to the locked position upon filling of the toilet tank with water by the water inlet valve assembly. That latch includes a control arm disposed in resting engagement upon a flush lever of the toilet tank to rotate the locking arm to the unlocked position in response to movement of the flush lever due to flushing. The hood includes a plurality of gripping arms allowing the hood to be assembled to the water inlet valve assembly with a snap fit and opposing side walls. The locking arm and stop extend between the hood and side walls with the stop being spaced from the locking arm in the direction of rotation of the latch to the unlocked position.

20 Claims, 1 Drawing Sheet

FLUSH VALVE LEAKAGE PREVENTION AND DETECTION DEVICE

CROSS-REFERENCE TO RELATED PATENT APPLICATIONS

This application is a continuation-in-part of U.S. patent application Ser. No. 07/830,302, filed Jan. 31, 1992, now U.S. Pat. No. 5,232,011 the disclosure of which is incorporated herein by reference.

BACKGROUND OF THE INVENTION

1. Field Of The Invention

The present invention pertains to toilet tanks and, more particularly, to devices for preventing and detecting leakage of water through flush valves of the toilet tanks between flush cycles.

2. Description Of The Prior Art

Most toilet tanks include a float movable with the water level in the tank during flush cycles to operate a water inlet valve to refill the tank upon lowering of the water from a predetermined level and to close the water inlet valve once the tank is refilled to the predetermined level. During flush cycles, operation of a flush lever unseats a flush valve in the tank causing the water in the tank to be released through a discharge opening, and the float descends in response to lowering of the water level from the predetermined level causing opening of the water inlet valve to refill the tank with closure of the flush valve. As the toilet tank is refilled, the float ascends in response to rising of the water level and, when the water level returns to the predetermined level, operates to close the water inlet valve and prevent further supply of water to the toilet tank. A problem exists where the water level in the tank drops from the predetermined water level not due to flushing but due to leakage, typically through the flush valve, between flush cycles in that the float operates to open the water inlet valve allowing water to flow into the tank to replace that lost through leakage. Where the leakage is continual, the float operates to keep the water inlet valve open such that water continually flows into the tank and through the discharge opening; however, the leakage can be sporadic or intermittent such that the float operates at unspecified times to open the water inlet valve. Both types of leakage commonly occur and are difficult to detect audibly and visually such that the leakage problem can remain undetected. In many cases, consumers are alerted to major, continual leakage only through drastically high water utility bills while insidious or sporadic leakage can remain unrecognized with consumers inadvertently absorbing inflated water utility costs of the leakage. In addition to a direct economic burden on consumers, the aggregate effect of water leakage through deficient flush valves of toilet tanks is the waste of untold gallons of water, an increasingly scarce resource.

Various devices have been proposed to prevent opening of water inlet valves of toilet tanks except when the flush levers are actuated such that refilling of the tanks between flush cycles is prevented when the water level drops due to leakage, and U.S. Pat. Nos. 4,901,377 to Weir, 4,843,657 to Orr, 3,095,577 to Clark, 2,841,169 to Martin et al, 265,709 to Sniffen and Great Britain Patent 488,402 are illustrative of such devices. Some of the disadvantages of prior art toilet tank leakage prevention devices are that the devices can not be easily retrofit to the many, diverse flush mechanisms and toilet tanks in use, the devices are structurally and functionally complex requiring numerous expensive components, the devices are not easily assembled on a common type of water inlet valve, i.e. the FLUIDMASTER type valve, found in existing toilet tanks, the devices are particularly susceptible to failure and malfunction, the devices do not limit the amount of water allowed to leak from the toilet tanks and the devices do not serve to promptly indicate or detect leakage.

SUMMARY OF THE INVENTION

Accordingly, it is primary object of the present invention to overcome the aforementioned disadvantages of prior art toilet tank leakage prevention and detection devices.

Another object of the present invention is to provide a flush valve leakage prevention and detection device for limiting leakage from a toilet tank to a single tank of water and thereafter preventing further leakage from the tank between flush cycles.

A further object of the present invention is to prevent refilling of a toilet tank upon emptying of the water in the tank due to leakage between flush cycles such that the empty tank will be discovered upon attempting to initiate the next flush cycle thereby serving as an indication or detection of leakage.

It is also an object of the present invention to support a float arm or lever of a float controlled water inlet valve assembly of a toilet tank in a raised position to prevent lowering of the arm or lever when the water level in the tank drops due to leakage between flush cycles such that the water inlet valve assembly is not opened.

Yet another object of the present invention is to hold a float arm or lever of a float controlled water inlet valve assembly of a toilet tank in a raised position and to allow the float arm or lever to move to a lowered position to open the water inlet valve assembly only upon initiation of a flush cycle.

A still further object of the present invention is to utilize a cam action to release a float arm or lever of a float controlled water inlet valve assembly of a toilet tank to allow opening of the water inlet valve assembly in response to rotation of a flush lever.

Another object of the present invention is to provide a flush valve leakage prevention and detection device with a control arm supported on a flush lever of a toilet tank such that movement of the flush lever is transmitted via the control arm to unlatch a float arm or lever arm of a float controlled water inlet valve assembly.

The present invention has as an additional object to provide a flush valve leakage prevention and detection device that can be easily assembled on or retrofit to FLUIDMASTER type water inlet valve assemblies.

It is also an object of the present invention to provide a flush valve leakage prevention and detection device that can be easily mounted on FLUIDMASTER type water inlet valve assemblies with a snap fit.

Yet another object of the present invention is to prevent over-rotation of a flush valve leakage prevention and detection device rotatable by a flush lever to unlatch a float arm of a float controlled water inlet valve assembly.

A still further object of the present invention is to ensure return of a flush valve leakage prevention and detection device to a lock position wherein the device holds a float arm of a float controlled water inlet valve assembly in a raised position following rotation of the device to an unlock position wherein the float arm is released from the device for movement to a lowered position.

Some of the advantages of the present invention are that leakage through flush valves can be detected without the need for dyes, audible listening devices and other extraneous products, continual, sporadic or intermittent leaks through flush valves can be readily detected, inflated water utility costs due to leakage through flush valves can be avoided, the flush valve leakage prevention and detection device can be easily retrofit to existing toilet tanks, the flush valve leakage prevention and detection device can be easily customized for installation on the various, diverse types of toilet tanks and flush mechanisms presently employed in toilet tanks, wasteful use of water can be eliminated, leakage of more than a single tank of water from toilet tanks is prevented, the flush valve leakage prevention and detection device can be used with conventional FLUIDMASTER type water inlet valves without requiring modification to the water inlet valves and the flush valve leakage prevention and detection device can be inexpensively manufactured with relatively few operating components for structural and functional simplicity and enhanced reliability.

The present invention is generally characterized in a flush valve leakage prevention and detection device including a hood for being assembled over a water inlet valve assembly with opposing side walls of the hood disposed on opposite sides of and extending in the same direction as a float lever of the valve assembly, a latch rotatably mounted by the hood to support or hold the float lever in a raised, latched position corresponding to a closed position for the water inlet valve assembly and a locked position for the latch and a stop for preventing over rotation of the latch to an unlocked position to release the float lever. The hood includes a plurality of gripping arms allowing the hood to be assembled on the valve assembly with a snap fit. The latch includes a locking arm extending between the hood side walls and a control arm supported in resting engagement on a flush lever for the toilet tank. The latch is movable or rotatable in response to movement of the flush lever in initiating a flush cycle to rotate the latch from the locked position to an unlocked position to release the float lever allowing the float lever to move to a lowered position corresponding to an open position for the water inlet valve assembly upon lowering of the water level in the toilet tank from a predetermined level due to opening of a flush valve with movement of the flush lever. The latch is movable in response to movement of the float lever from the lowered position to the raised position with raising of the water level in the tank to automatically return to the locked position to engage and latch the float lever in the raised position corresponding to the closed position for the water inlet valve assembly such that the water inlet valve assembly remains closed and cannot be opened in the event that water leaks from the tank prior to the next flush cycle. Should water leak from the toilet tank through the flush valve, only a single tank of water will be allowed to leak, and the empty tank will provide an indication or detection of leakage at the next flush cycle. The stop extends between the side walls of the hood and is spaced from the latch in the direction of rotation of the latch toward the unlocked position such that over rotation of the latch to the unlocked position is prevented to ensure return of the latch automatically to the locked position.

These and other objects and advantages of the present invention will become apparent from the following description of the preferred embodiments taken in conjunction with the accompanying drawings.

DESCRIPTION OF THE PREFERRED EMBODIMENTS

Figures 1, 2, 3, 4, 5:
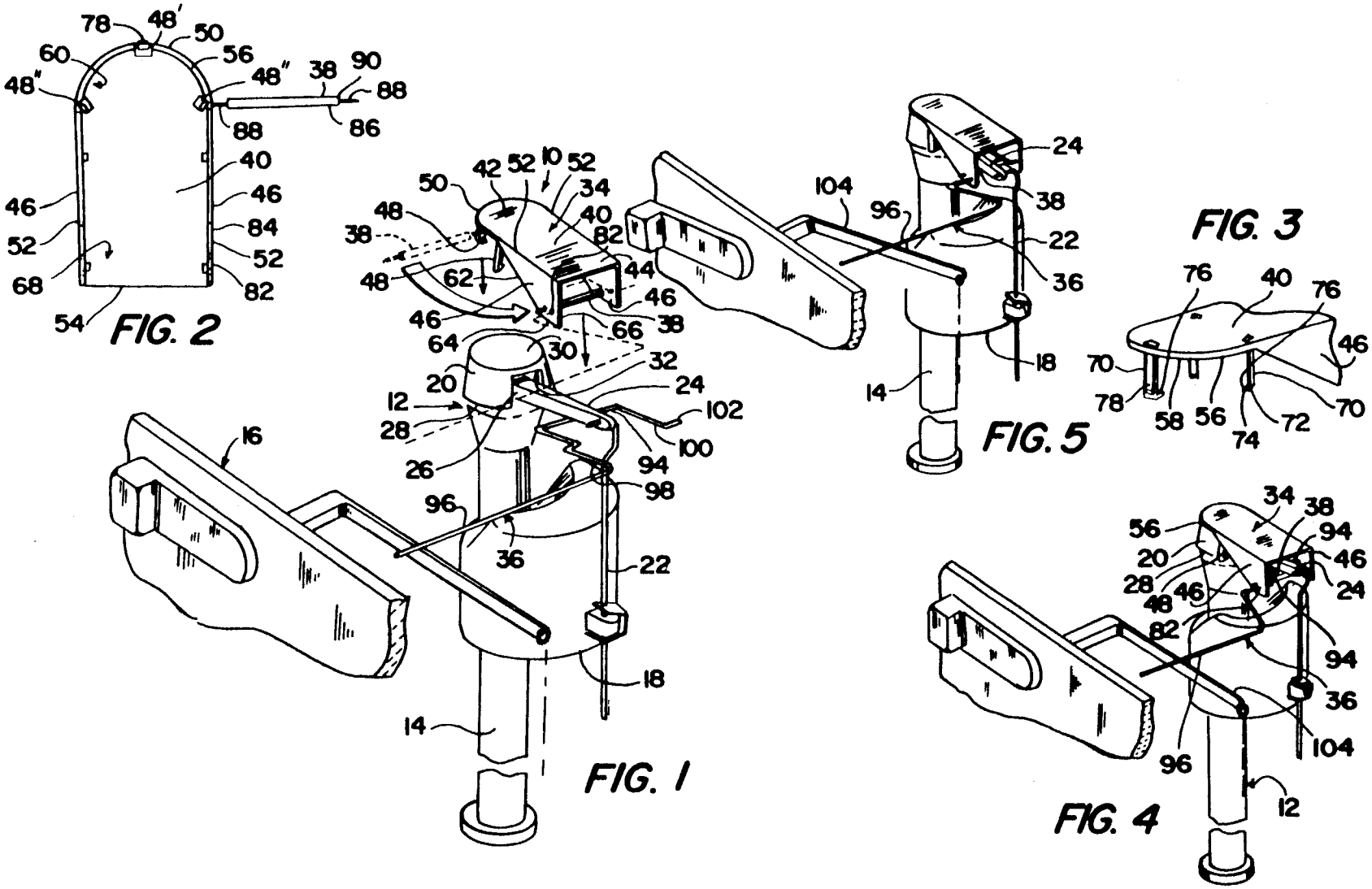
FIG. 1 is a broken perspective view, partly in section, of a flush valve leakage prevention and detection device according to the present invention.
FIG. 2 is a bottom plan view of the hood of the flush valve leakage prevention and detection device of FIG. 1.
FIG. 3 is a broken perspective view of the hood of the flush valve leakage prevention and detection device of FIG. 1.
FIG. 4 is a broken perspective view, partly in section, of the flush valve leakage prevention and detection device of FIG. 1 showing the latch in a locked position.
FIG. 5 is a broken perspective view, partly in section, of the flush valve leakage prevention and detection device showing the latch in an unlocked position.

A flush valve leakage prevention and detection device 10 according to the present invention is shown in FIG. 1 for use in toilet tanks having conventional FLUIDMASTER type water inlet valve assemblies. A FLUIDMASTER water inlet valve assembly 12 as shown in FIG. 1 includes a water supply pipe 14 for being mounted on a bottom or lower wall of a toilet tank 16, a water inlet valve housed within the valve assembly 12, a float 18 mounted for sliding movement upwardly and downwardly along the supply pipe 14 in response to raising and lowering of the water level within the toilet tank and a cover 20 at an uppermost end of the supply pipe 14. The float 18 is coupled by an arm 22 to a float lever or arm 24 that is pivotally mounted at 26 to the valve assembly 12 with the float lever extending in a transverse or perpendicular direction from the supply pipe 14. Float lever 24 pivots in response to movement of float 18 along the supply pipe to close the water inlet valve when the float is in a raised position corresponding to a predetermined water level in the toilet tank and to open the water inlet valve when the float is in a lowered position due to the water level in the tank having dropped or been lowered from the predetermined level. Cover 20 has a truncated conical configuration tapering from a circular or annular lower edge 28 to a circular upper surface 30 and a window 32 allowing passage therethrough by float lever 24.

The flush valve leakage prevention and detection device 10 includes a cap or hood 34 for being assembled to the water inlet valve assembly, latch 36 rotatably or pivotably mounted by the hood to support or hold the float lever 24 in a raised, latched position corresponding to a closed position for the water inlet valve and a locked position for the latch and a stop 38 for limiting rotation of latch 36 from the locked position to an unlocked position to release the float lever 24 to move to a lowered, unlatched position corresponding to an open position for the water inlet valve. As shown in FIGS. 1, 2 and 3, hood 34 includes a planar upper or top wall 40 having a rearward section 42 for being mounted over cover upper surface 30 and a mounting or forward section 44 extending beyond the cover to be disposed over float lever 24 in cantilevered fashion, a pair of opposing side walls 46 joined to mounting section 44 for mounting latch 36 and a plurality of gripping arms 48 depending from rearward section 42 for securing hood 34 on cover 20. Rearward section 42 can have any desired configuration or shape in accordance with the configuration or shape of cover 20 and upper surface 30 thereof. As shown in FIGS. 2 and 3, rearward section 42 has a curved upper rearward edge 50 defining a partial circular configuration corresponding to the circular configuration of cap upper surface 30. Mounting section 44 can have any desired configuration or shape to extend over float lever 24 in the same direction as the float lever and to position hood side walls 46 to mount latch 36 as will be explained further below. As shown, forward section 44 has a rectangular configuration with opposing parallel upper side or lateral edges 52 extending from opposing ends of upper rearward edge 50 and an upper forward edge 54 joining upper side edges 52. A rim 56 extends along upper rearward edge 50 and depends from top wall 40 to terminate at a lower rearward edge 58. A forward recess 60 is defined between top wall 40 and lower rearward edge 58 for receiving the upper surface 30 of cover 20 with rim 56 extending around the cover. Side walls 46 extend perpendicularly or substantially perpendicularly from top wall 40 along upper side edges 52, and the side walls extend lengthwise in the same direction as float lever 24. The side walls 46 are parallel or substantially parallel to one another and merge with rim 56. The side walls 46 can have any desired configuration or shape to mount latch 34; and, as shown in FIG. 1, each of the side walls 46 has a diagonal first intermediate lower edge 62 extending from lower rearward edge 58 at an acute angle, a second intermediate lower edge 64 extending forwardly from first intermediate lower edge 62 in a direction transverse or perpendicular thereto and a lower forward edge 66 joining second intermediate lower edge 64 with upper forward edge 54 transversely or perpendicularly. A rearward recess 68 communicating with forward recess 60 is defined in hood 34 between top wall 40 and the lower first intermediate, second intermediate and forward edges. The juncture of the lower first intermediate edge and the lower second intermediate edge and the juncture of the lower second intermediate edge with the lower forward edge can be radiused or curved as shown to eliminate sharp edges.

Gripping arms 48 depend from top wall 40 in the same direction as rim 56, three arms 48 being shown in FIG. 2 with one arm 48' located at or substantially at the mid-point of rim 56 and the other arms 48" located at the opposing ends of rim 56. Each of the arms 48 has a major portion 70 depending perpendicularly or transversely or substantially perpendicularly or transversely from rim 56 and/or top wall 40, a minor portion 72 bent inwardly from the major portion at a slight angle and a locking finger 74 bent inwardly from the minor portion 72 in a direction transverse thereto. Major portions 70 extend lengthwise from rim 56 and/or top wall 40 with a uniform or substantially uniform thickness and a width that tapers from a maximum width at the rim and/or top wall to a minimum width at minor portions 72. Minor portions 72 extend lengthwise from major portions 70 with a uniform or substantially uniform thickness the same or substantially the same as the thickness of the major portions and a uniform or substantially uniform width the same or substantially the same as the minimum width. Fingers 74 are acutely angled from minor portions 72 and extend lengthwise therefrom with a uniform width the same or substantially the same as the width of the minor portions and a tapered thickness to terminate at raised nubs 76 of reduced thickness protruding from fingers 74 in the direction of top wall 40. Arms 48 can be attached to rim 56 and/or to the top wall 40; and, as shown, the arms are attached to the top wall with arm 48' disposed just inwardly of rim 56 and arms 48" disposed inwardly of side walls 46. Arms 48 are arranged along or slightly inwardly of the circumference defined by rim 56 with fingers 74 extending in a radial direction of the circumference, i.e. radially toward the center of the circle defined by the rim. Arms 48 are movable or pivotable outwardly from the circumference in a radial direction to permit hood 34 to be mounted with a snap-fit on cover 20. Arms 48 can be made movable or pivotable in many various ways such as with spring like hinge connections to the rim 56 and/or the top wall 40. One preferred way of making arms 48 movable in the radially outward direction is to fabricate the hood 34 unitarily, integrally as a molding of semi-flexible material, such as plastic, as shown such that arms 48 are resilient or flexible and can bend to permit assembly of hood 34 on the cover 20. Ribs 78 can be provided on the arms 48 for additional strength.

Aligned latch mounting holes 82 are formed in side walls 46 to be disposed rearwardly of lower forward edge 66 and upwardly of lower second intermediate edge 64 for mounting latch 36 as will be explained further below. Aligned stop mounting holes 84 are formed in side walls 46 to be disposed rearwardly of and below the latch mounting holes 82 for mounting stop 38 as will be explained further below. Stop 38 includes a bar 86 and pins 88 extending from shoulders 90 at opposing ends of bar 86. Bar 86 has a length that is the same or substantially the same as the distance between side walls 46 to permit bar 86 to be mounted between the sidewalls 46 with shoulders 90 touching or very close to the side walls. Pins 88 have an outer diameter or size to fit snugly in stop mounting holes 84 for frictional retention with hood 34 and a length at least equal to and, preferably, somewhat grater than, the thickness of side walls 46. Leakage prevention and detection device 10 is normally supplied with stop 38 attached thereto but not mounted in stop mounting holes 84. As shown, stop 38 is attached to rim 56 by one of the pins 88, and this attachment that can easily be broken by a consumer prior to use.

Latch 36 is preferably formed of a single length of wire or rod bent or configured to form a substantially straight locking arm or section 94, a control or section arm 96 parallel with locking arm 94, a connecting section 98 joining a first end of locking arm 94 to control arm 96 perpendicularly and an L-shaped extension 100 joined to a second end of the locking arm 94. Extension 100 defines a mounting finger 102 parallel or substantially parallel to the locking arm. The mounting finger 102 and a portion of the locking arm 94 extend through the latch mounting holes 82 to rotatably mount the latch to the hood 34.

According to a method of operation for the flush valve leakage prevention and detection device 10, hood 34 is normally supplied with stop 38 attached to rim 56 by pin 88 as shown in FIG. 2 and in dotted lines in FIG. 1 and latch 36 not mounted to hood 34. As shown in FIG. 4, hood 34 is assembled to the water inlet valve assembly 12 with a snap fit by pushing the hood 34 down upon the cover 20 at the upper end of water supply pipe 14 causing gripping arms 48 to bend in a direction outwardly of rim 56 and to snap back into place such that nubs 76 are engaged beneath the lower edge 28 of cover 20 with cover 20 received within the hood forward recess 60. Latch 38 is mounted to hood 34 by placing the locking arm 94 through the latch mounting hole 82 on a side wall 46 facing the flush lever 104 and the mounting finger 102 through the other latch mounting hole 82 such that the locking arm 94 is disposed beneath or under the float lever 24. With the latch so mounted, locking arm 94 extends between the side walls 46, and the control arm 96 rests upon the flush lever 104 transverse thereto. Stop 38 is detached from rim 56 by breaking off pin 88, and the pins 88 are inserted in the stop mounting holes 84 such that the stop extends between the side walls 46 rearwardly of the locking arm. By forming hood 34 of a resilient plastic material, assembly of the latch and stop is facilitated due to the resiliency of side walls 46. By forming latch 36 of bendable wire, the latch can be configured by a consumer during use in accordance with the particular arrangement of the float lever and flush lever. The latch 36 will be disposed in a rest, locked position as shown in FIG. 4 with the locking arm 94 disposed under and supporting the float lever 24 and the control arm 96 disposed over and supported by the flush lever 104, with the locking arm 94 and the control arm 96 extending transverse to the float lever 24 and the flush lever 104, respectively. The relatively greater weight of the latch 36 at the control arm 96 rotationally biases the latch 36 clockwise around the latch mounting holes, looking at FIG. 4, such that the locking arm 94 is urged upwardly against the float lever 24 and the control arm 96 is urged downwardly against the flush lever 104. Accordingly, the float lever 24 is firmly held by the latch 36 in a raised, latched position corresponding to a closed position for the water inlet valve assembly 12 and the control arm 96 extends exteriorly of the hood side wall to be urged against the flush lever. When a flush cycle is initiated with the water level in the toilet tank at the predetermined level, the flush lever 104 will be rotated upwardly in a counterclockwise direction looking at FIG. 5 causing the latch 36 to rotate counterclockwise to an unlocked position. With counterclockwise rotation of latch 36, the control arm 96 will be moved or cammed upwardly by the flush lever 104 while the locking arm 94 will be rotated rearwardly and downwardly thusly releasing or unlatching the float lever 24. The float 18 is then free to descend along the supply pipe 14 to a lowered position as the water level in the tank drops due to opening of the flush valve via the flush lever 104. The float lever 24 will be pivoted downwardly, or clockwise, in response to lowering of the float 18 due to coupling of float 18 with the float lever 24 via the arm 22 to open the water inlet valve assembly 12, with the weight of the float 18 upon float lever 24 causing the float lever to override the rotational bias of the latch 36. As the water level in the tank rises with water supplied from the water inlet valve assembly 12, the float 18 rises causing the float lever 24 to pivot counterclockwise while the greater weight of the latch 36 at the control arm 96 allows the latch to automatically return to the rest or locked position such that the locking arm 94 again supports the float lever 24 in the raised, latched position corresponding to closure of the water inlet valve assembly. Over-rotation of the latch 36 from the locked to the unlocked positions is prevented in that the stop 38 limits rotation of locking arm 94 in the counterclockwise direction thusly ensuring that the latch will return to the locked position. Should water leak from the toilet tank between flush cycles, the float lever 24 will remain held by latch 36 in the raised position such that the water inlet valve assembly will remain closed. Only a single tank of water will be allowed to leak from the toilet tank in the event of leakage, and the empty tank will serve as an indication of leakage at the next flush cycle.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A flush valve leakage prevention and detection device for use in a toilet tank having a flush lever movable to flush the toilet tank and a float controlled water inlet valve assembly operated by a float lever comprising:

hood means for being assembled to the water inlet valve assembly and including opposing side walls for being disposed on opposite sides of the float lever and extending in the same direction as the float lever;

a latch including a locking section for holding the float lever in a raised position corresponding to a closed position for the water inlet valve assembly and a control section supported on the flush lever and movable with the flush lever to pivot said latch to release said locking section from the float lever in response to movement of the flush lever to flush the toilet tank whereby the float lever is allowed to move to a lowered position corresponding to an open position for the water inlet valve assembly; and means for pivotally mounting said latch on said hood means with said locking section disposed between said side walls transverse to the float lever and said control section disposed transverse to the flush lever.

2. A flush valve leakage prevention and detection device as recited in claim 1 wherein said side walls are substantially parallel to one another and to the float lever.

3. A flush valve leakage prevention and detection device as recited in claim 2 wherein said hood means further includes a top wall transversely joining said side walls and being disposed over the float lever when said hood means is assembled to the water inlet valve assembly.

4. A flush valve leakage prevention and detection device as recited in claim 3 wherein said top wall includes a section extending beyond said side walls for being disposed over the water inlet valve assembly.

5. A flush valve leakage prevention and detection device as recited in claim 4 and further including a plurality of resilient arms depending from said top wall section for being disposed around the water inlet valve assembly in frictional retention with the water inlet valve assembly when said top wall section is disposed over the water inlet valve assembly.

6. A flush valve leakage prevention and detection device as recited in claim 5 wherein said hood means is made integrally, unitarily as one piece.

7. A flush valve leakage prevention and detection device as recited in claim 5 wherein said locking section and said control section are made integrally, unitarily as a single piece of bent wire.

8. A flush valve leakage prevention and detection device as recited in claim 5 wherein said mounting means includes a pair of aligned holes in said side walls for receiving said latch.

9. A flush valve leakage prevention and detection device for use in a toilet tank having a flushed lever movable to flush the toilet tank and a float controlled water inlet valve assembly operated by a float lever extending from a water supplied pipe comprising a hood having resilient gripping means for engaging a portion of the water inlet valve assembly to allow said hood to be assembled over the water supply pipe with a snap fit; and a latch rotatably mounted on said hood and including a locking arm for holding the float lever in a raised position corresponding to a closed position for the water inlet valve assembly and a control arm for being supported on the flush lever, said control arm being movable with the flush lever to rotate said locking arm from a locked position wherein the float lever is held in the raised position by said locking arm and an unlocked position wherein said locking arm is released from the float lever in response to movement of the flush lever to flush the toilet tank whereby the float lever is allowed to move to a lowered position corresponding to an open position for the water inlet valve assembly.

10. A flush valve leakage prevention and detection device as recited in claim 9 wherein the water inlet valve assembly includes a cover disposed over an upper end of the water supply pipe, said hood includes a top wall for being disposed over the cover and said gripping means includes a plurality of gripping arms extending in a substantially perpendicular direction from said top wall for gripping the cover with a snap fit.

11. A flush valve leakage prevention and detection device as recited in claim 10 wherein the cover has a lower edge and further including fingers extending inwardly from said gripping arms at an acute angle for engaging the lower edge of the cover.

12. A flush valve leakage prevention and detection device as recited in claim 11 and further including strengthening ribs on said gripping arms.

13. A flush valve leakage prevention and detection device as recited in claim 12 wherein said hood is integrally, unitarily molded as a single piece of plastic material.

14. A flush valve leakage prevention and detection device as recited in claim 12 wherein said top wall extends beyond the cover in the same direction as the float lever and said locking arm extends between said side walls and said control arm extends exteriorly of said side walls.

15. A flush valve leakage prevention and detection device as recited in claim 9 and further including means for preventing over rotation of said locking arm from said locked position to said unlocked position.

16. A flush valve leakage prevention and detection device for use in a toilet tank having a flush lever movably to flush the toilet tank and a float controlled water inlet valve assembly operated by a float lever comprising a hood means being disposed over the float lever;

a latch including a locking section for engaging the float lever to hold the float lever in a raised position corresponding to a closed position for the water inlet valve assembly and a control section supported on the flush lever and movable with the flush lever to rotate said latch to disengage said locking section from the float lever in response to movement of the flush lever to flush the toilet tank whereby the float lever is allowed to move to a lowered position corresponding to an open position for the water inlet valve assembly;

support means for rotatably mounting said latch in the toilet tank; and means disposed on the hood means for preventing over rotation of said latch when said latch is rotated to disengage said locking section from the float lever whereby said locking section is permitted to automatically re-engage the float lever to hold the float lever in the raised position upon return of the float lever to the raised position with filling up the toilet tank with water from the water inlet valve assembly.

17. A flush valve leakage prevention and detection device as recited in claim 16 wherein said locking section extends transverse to the float lever and said over rotation preventing means includes a stop spaced from said locking section in the direction of rotation of said latch to disengage said locking section.

18. A flush valve leakage prevention and detection device as recited in claim 16 wherein the hood means includes a hood for being secured to the water inlet valve assembly, said hood including a pair of opposing side walls and wherein said latch and said over rotation preventing means are mounted between said side walls.

19. A flush valve leakage prevention and detection device as recited in claim 18 wherein said stop includes opposing ends and further including aligned apertures in said side walls for frictionally receiving said opposing ends.

20. A flush valve leakage prevention and detection device as recited in claim 19 wherein said stop is provided attached to said hood by one of said opposing ends, said one opposing end adapted to be broken away from said hood by a consumer to allow said opposing ends to be inserted in said apertures.

* * * * *